US005184554A

United States Patent [19]

Merkel et al.

[11] Patent Number: 5,184,554

[45] Date of Patent: Feb. 9, 1993

[54] QUICK-ACTION CLAMPING DEVICE

[75] Inventors: Gerd Merkel, Dielheim; Georg Glaunsinger, Meckesheim; Wilfried Vogt, Walldorf; Peter Stadler; Claus-Peter Zander, both of Heidelberg; Gernot Schmitt; Jürgen Maass, both of Wiesloch; Thomas Necker, Sandhausen; Willi Becker, Bammental; Walter Weber, Heidelberg, all of Fed. Rep. of Germany

[73] Assignee: Heidelberger Druckmaschinen AG, Heidelberg, Fed. Rep. of Germany

[21] Appl. No.: 812,714

[22] Filed: Dec. 23, 1991

[30] Foreign Application Priority Data

Dec. 21, 1990 [DE] Fed. Rep. of Germany ..... 4041452
Sep. 7, 1991 [DE] Fed. Rep. of Germany ..... 4129831

[51] Int. Cl.[5] ..... B41F 1/28

[52] U.S. Cl. ..... 101/415.1; 101/378; 101/409

[58] Field of Search ..... 101/378, 415.1, 409

[56] References Cited

U.S. PATENT DOCUMENTS

| | | | |
|---|---|---|---|
| 3,715,981 | 2/1973 | Huffman | 101/415.1 |
| 4,068,586 | 1/1978 | Frey et al. | 101/415.1 |
| 4,183,299 | 1/1980 | Cappel | 101/415.1 |
| 4,250,810 | 2/1981 | Fowler et al. | 101/415.1 |
| 4,759,290 | 7/1988 | Höll et al. | 101/415.1 |
| 4,823,698 | 4/1989 | Ruger et al. | 101/378 |
| 4,938,134 | 7/1990 | Dörsam et al. | 101/378 |
| 4,977,833 | 12/1990 | Inage | 101/415.1 |

FOREIGN PATENT DOCUMENTS

| | | |
|---|---|---|
| 3401351 | 7/1985 | Fed. Rep. of Germany . |
| 8710030 | 10/1987 | Fed. Rep. of Germany . |
| 926530 | 10/1947 | France . |
| 454912 | 6/1968 | Switzerland . |

*Primary Examiner*—Edgar S. Burr
*Assistant Examiner*—J. R. Keating
*Attorney, Agent, or Firm*—Herbert L. Lerner; Laurence A. Greenberg

[57] ABSTRACT

A quick-action clamping device for fastening a printing plate on a plate cylinder in a printing machine by a fixed clamping bar and a displaceable clamping bar which are able to be brought into a clamping position and a plate-changing position, respectively, includes a spring device for resiliently pressing the displaceable clamping bar into the clamping position with a holding force for clamping a printing plate between the displaceable clamping bar and the fixed clamping bar, and at least one re-set element for returning the displaceable clamping bar to the plate-changing position against the holding force.

14 Claims, 5 Drawing Sheets

QUICK-ACTION CLAMPING DEVICE

SPECIFICATION

The invention relates to a quick-action clamping device for fastening printing plates in printing machines by means of a fixed clamping bar and a displaceable clamping bar which are able to be brought into a clamping position and into a plate-changing position, respectively.

German Published Non-Prosecuted Application (DE-OS) 34 01 351 discloses a quick-action clamping device of this general type in which a lower clamping bar is pressed against an upper clamping bar by suitably turning an eccentric while a printing plate is clamped therebetween. By turning the eccentric in an opposite direction, the lower clamping bar is retracted and the printing plate may then be changed.

With such quick-action clamping devices, the pressman has to actuate or operate the eccentric by means of a tool, e.g. a mandrel, in order to change printing plates. When a printing plate is being changed, it is not possible to set any defined clamping force, which results in an indefinable upward bending of the upper clamping bar. Consequently, no exact, reproducible plate positioning can be achieved.

It is accordingly an object of the invention to provide a quick-action clamping device with which a defined clamping force can be achieved for clamping a plate, and which is well suited for automatic plate clamping.

With the foregoing and other objects in view, there is provided a quick-action clamping device for fastening a printing plate on a plate cylinder in a printing machine by means of a fixed clamping bar and a displaceable clamping bar which are able to be brought into a clamping position and a plate-changing position, respectively, comprising spring means for resiliently pressing the displaceable clamping bar into the clamping position with a holding force for clamping a printing plate between the displaceable clamping bar and the fixed clamping bar, and at least one reset element for returning the displaceable clamping bar to the plate-changing position against the holding force.

The advantages of the invention are that, due to the force of the spring means, a defined clamping force for clamping the printing plate is achieved, and that the presence of this clamping force is assured even if the adjusting device is not supplied with power because of a power failure. Due to the defined clamping force, an exact positioning is achieved and the fixed clamping bar is, at most, bent upwardly only slightly and, if so, always so as to be reproducible. The printing plate may be clamped on pushbutton command. Consequently, the pressman no longer needs any tools for mounting the printing plate. It is also conceivable to clamp the printing plate automatically in cooperation with an automatic plate feed.

In accordance with another feature of the invention, the plate cylinder has a housing, and the re-set element comprises at least one rocker braced against the cylinder housing, and at least one adjusting device for actuating the rocker, respective ends of the rocker being operatively connected to the displaceable clamping bar and to the adjusting device.

In accordance with alternate features of the invention, the adjusting device is automatically actuatable, e.g. in the form of a pneumatic or a hydraulic adjusting device having one or more pneumatic or hydraulic cylinders.

The rocker may be a continuous element extending along the clamping bar, and may be formed with a number of finger-shaped ends engaging in suitable recesses formed in the displaceable clamping bar and actuated by one or more of the adjusting devices. It is also conceivable, moreover, to provide a number of rockers, each provided with a respective adjusting device.

In accordance with a further feature of the invention, the plate cylinder has a housing, and the re-set element comprises at least one lever having an end thereof braced against a supporting surface of the cylinder housing and an adjusting device for the lever, the lever having a relatively short lever arm operatively engageable with the displaceable clamping bar, and a relatively long lever arm operatively engageable with the adjusting device.

In accordance with an added feature of the invention, the lever engages in a recess formed in the displaceable clamping bar.

In accordance with an alternate feature of the invention, the relatively short lever arm of the lever engages between the spring means and the displaceable clamping bar, and there are included restoring spring means firmly connected to the cylinder housing for pressing the displaceable clamping bar against the lever with a restoring force sufficient to overcome friction and inertia of the displaceable clamping bar.

In accordance with another alternate feature of the invention, the adjusting device is disposed between the lever and one end of a rocker, the rocker being braced against the cylinder housing, the end of the rocker engaging in a recess formed in the displaceable clamping bar, the relatively short lever arm of the lever engaging between the spring means and the displaceable clamping bar.

A special advantage of this last-mentioned constructive embodiment is that a multiple increase in force is provided thereby in an extremely limited space. The adjusting device acts both on the lever and on the rocker, so that the respective transmissions of force from the rocker and from the lever to the displaceable clamping bar are added or summed. If the force of the adjusting device is doubled, for example, by the lever, and the rocker provides a single-force transmission, the result of this construction is that the displaceable clamping bar is actuated with triple the force of the adjusting device.

It must be stressed that, as with the rocker, various constructions of the lever are possible. The lever may thus be constructed as a continuous element extending along the displaceable clamping bar, the lever being braced by a number of finger-shaped ends thereof against a supporting surface of the cylinder housing, the relatively long arm of the lever being actuated by one or more adjusting devices. It is also possible, moreover, to arrange a number of levers over the length of the displaceable clamping bar with a respective adjusting device assigned to each of the levers. In a combination of rocker and lever, each of these elements may be constructed in one or the other manner, as long as each adjusting device acts both on the lever and on the rocker.

In accordance with an added feature of the invention, there is provided a retention pin projecting from the supporting surface of the cylinder housing, the retention pin engaging in a bore formed in the lever with sufficient play to afford movability of the lever.

A very exact positioning of the printing plate is achieved, in accordance with yet another feature of the invention, by a support connected to the cylinder housing, and a pressure spring disposed between and in bracing engagement with the support and the displaceable clamping bar for ensuring a neat abutment of the displaceable clamping bar against the cylinder housing in a direction towards the clamped printing plate. In this manner, when mounting and clamping the printing plate, the exact positioning of the printing plate, which is in contact with register pins, is prevented from being affected by play between the displaceable clamping bar and the cylinder housing.

In this regard, in accordance with yet a further feature of the invention, there are included register pins carried by one of the clamping bars for precisely mounting and positioning the printing plate, the other of the clamping bars being formed with recesses located opposite the register pins. This exact positioning is always reproducible. If the printing plate is formed with U-shaped recesses, the register pins do not have to be moved out of the recesses when the printing plate is inserted.

In accordance with yet an additional feature of the invention, the clamping bars have clamping surfaces coated with a material having a high coefficient of friction.

More specifically in accordance with the invention, the material coating the clamping surfaces is formed of tungsten carbide cobalt.

In accordance with yet an added feature of the invention, the clamping bars have respective clamping surfaces, and one of the clamping surfaces of the clamping bars is formed as a smooth metal surface, and the other of the clamping surfaces is a knurled surface. With the aid of such clamping surfaces, the printing plate is held without deformation in the clamping region thereof. Thus, no problems are posed with respect to multiple re-use of the same printing plates.

Especially in the case of automatic insertion of printing plates, it is another feature of the invention to include at least two sensors for detecting whether a printing plate received between the clamping bars is properly positioned.

If the quick-action clamping device is used in printing machines processing relatively large formats, in accordance with a concomitant feature of the invention, one end of the printing plate is clampable between the clamping bars, and there is included a clamping and tensioned device for holding and tensioning the other end of the printing plate. Due to the exact fixing of the printing plate with great forces, the quick-action clamping device is especially suited for such machines, because the clamping and tensioning device ensures the application of a great tensional force. This, in turn, is advantageous to the exact positioning and fixing of the printing plate in order to achieve a register-true print.

Other features which are considered as characteristic for the invention are set forth in the appended claims.

Although the invention is illustrated and described herein as embodied in a quick-action clamping device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
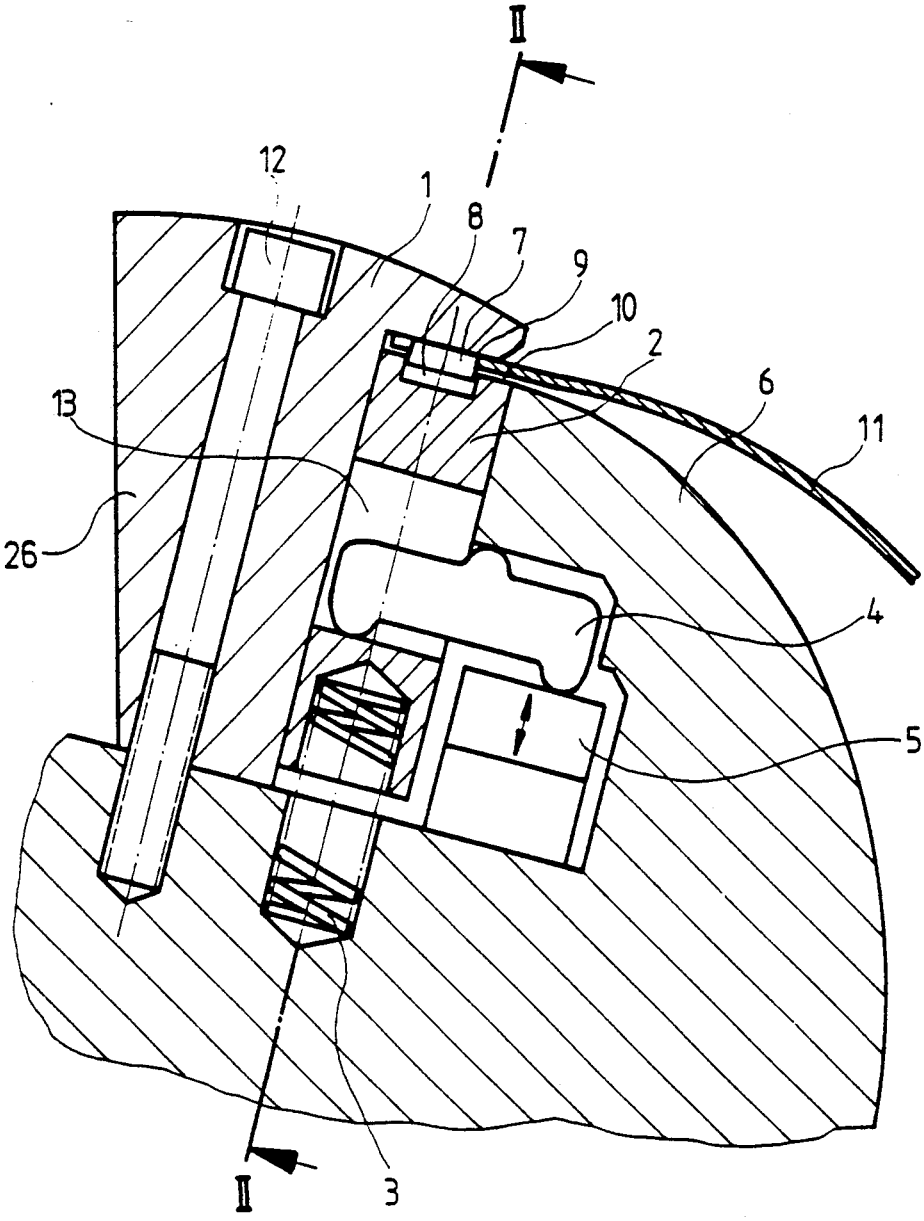
FIG. 1 is a radial section of a plate cylinder incorporating the quick-action clamping device according to the invention.

Referring now to the drawings and, first, particularly to FIG. 1 thereof, there is shown therein a cross-sectional view of a quick-action clamping device disposed on a plate cylinder in the vicinity of a spring element 3, a re-set element 4 and an adjusting device 5. An upper clamping bar 1 is of fixed construction; it may be disposed, for example, on a support 26 connected to a housing 6 of the plate cylinder by means of a fastening screw 12. For clamping a printing plate 11, the upper clamping bar 1 cooperates with a lower clamping bar 2 which is constructed so as to be displaceable. One or more of the spring elements 3 are arranged between the cylinder housing 6 and the displaceable lower clamping bar 2 for pressing the clamping bar 2 with a desired clamping force against the upper clamping bar 1. By means of one or more of the re-set elements 4, the lower clamping bar 2, by overcoming the force of the spring elements 3, is brought into a plate-changing position wherein a sufficiently wide receiving gap exists between the clamping surfaces 9 and 10 of the clamping bars 1 and 2. Register pins 7 may be provided which are insertable in-register into correspondingly U-shaped punch holes or recesses formed in the printing plate 11, thereby assuring an always precise positioning of the printing plate 11. Opposite the register pins 7, recesses 8 are formed in the clamping bar 2 for receiving the register pins 7 therein. If the re-set element 4 which, as illustrated in FIG. 2, may be formed of a number of axially arranged components releases the displaceable lower clamping bar 2, the latter is pressed with the force of the spring elements 3 against the upper clamping bar thereby clamping the printing plate 11.

In this embodiment of the invention is shown in FIG. 1, the re-set element may be constructed as several rockers 4 (only one of which is shown) having a respective pivot point at the cylinder housing 6, each of the rockers 4 having one end thereof, respectively, engaging in a hole 13 formed in the lower clamping bar 2, the respective other end of each of the rockers being operatively engageable with a respective adjusting device 5. By actuating the adjusting device 5, the rockers 4 press the displaceable lower clamping bar 2 downwardly and release the clamping bar 2 again by re-setting the adjusting device 5, the printing plate being subjected to tension by spring elements 3 as described hereinbefore. The adjusting device may be constructed so as to be automatically actuatable, such as a pneumatic or hydraulic cylinder, for example.

In all of the embodiments of the invention, the clamping surfaces 9 and 10 of the clamping bars 1 and 2, respectively, may be coated with a material having a high coefficient of friction, or one clamping surface may be formed as a smooth metal surface, and the other as a knurled surface. Two non-illustrated sensors can be provided which monitor whether or not the printing plate is located in its proper position.

Figure 2:
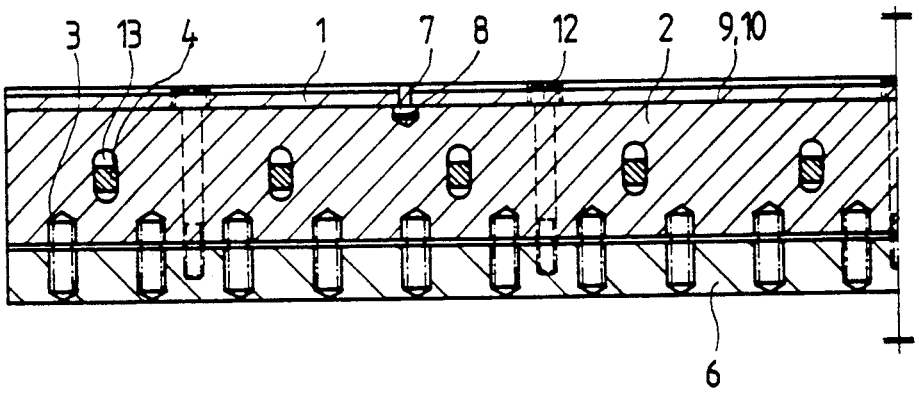
FIG. 2 is a reduced fragmentary sectional view of FIG. 1 taken along the line II—II and showing the quick-action clamping device extending in axial direction.

In the sectional view of FIG. 2, the quick-action clamping device is shown in axial direction along the line II—II of FIG. 1. The quick-action clamping device, as illustrated, is in clamping position, yet not clamping a printing plate. The section line II-II extends through the fixed upper clamping bar 1 and the displaceable lower clamping bar 2, in the vicinity of the center line of the lower clamping bar 2. Depending upon the length of the clamping bar 2, a suitably greater or lesser number of spring elements 3, re-set elements 4 and fastening screws 12 are provided. In a quick-action clamping device, it is advantageous to arrange two register pins 7 spaced sufficiently apart. Embodiments of the invention described hereinafter may also have a great number of individual elements which are distributed over the length of the clamping bars 1 and 2.

Figure 3:
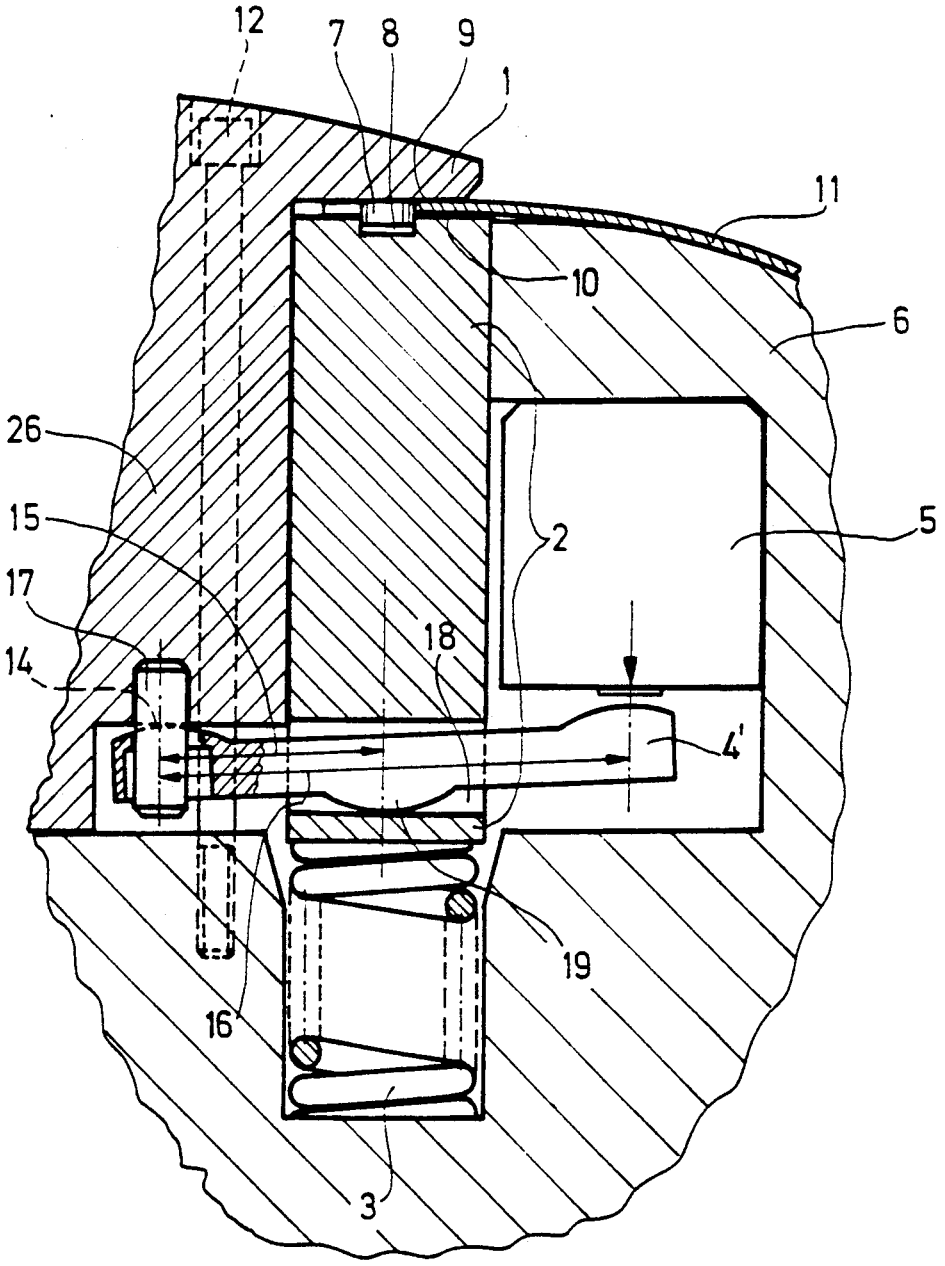
FIG. 3 is a view like that of FIG. 1 of another embodiment of the invention wherein an increase in force is realized.

FIG. 3 is a sectional view, similar to that of FIG. 1 of an embodiment of the invention having a lever 4' providing power or force amplification. In this embodiment, the lever 4' which is actuatable by the adjusting device 5 serves as a re-set element. The adjusting device 5 is mounted in the cylinder housing 6, and has an actuating member directed, as represented by the arrow towards the interior of the cylinder. The lever 4' extends through a perforation or hole 18 formed in the displaceable lower clamping bar 2, a spherical bearing-surface area 19 being provided on the lever 4' facing towards the spring element 3. An end of the lever 4', which is located opposite from an end thereof which is adjacent the adjusting device 5 is braced against a supporting surface 14 formed on a support 26 which is firmly connected to the cylinder housing 6 by means of a fastening screw 12. A retention pin 17 engaging in a bore formed in the lever 4' projects out of the supporting surface 14, sufficient play being afforded to permit the lever 4' to move, i.e., pivot at the bearing-surface area.

The quick-action clamping device according to the invention operates as follows:

If the adjusting device 5, e.g., a pneumatic cylinder, has no compressed air therein, the spring element 3 presses the displaceable lower clamping bar 2 fully against the fixedly mounted upper clamping bar 1, thereby fixing a printing plate 11 therebetween. Register pins 7 and recesses 8 function as described hereinbefore regarding the embodiment of FIG. 1. For releasing the printing plate 11, the adjusting device 5, which, via the lever 4', presses a part of the lower clamping bar 2 disposed below the perforation or hole 18 against the spring element 3, is actuated, thereby compressing the spring element 3. Simultaneously, while the spring element 3 is being compressed, the clamping bar 2 is automatically shifted downwardly, as viewed in FIG. 3, thereby freeing the printing plate 11. Measured from the supporting surface 14 to the spherical pressure area 19, the lever 4' has a relatively short lever arm 15 and also has a relatively long lever arm 16 extending from the supporting surface 14 to the adjusting device 5 in the embodiment of FIG. 3. The relatively long lever arm 16 is twice as long as the lever arm 15, thereby doubling the effective force of the adjusting device 5. The lever ratios may, of course, be selected at will.

Figure 4:
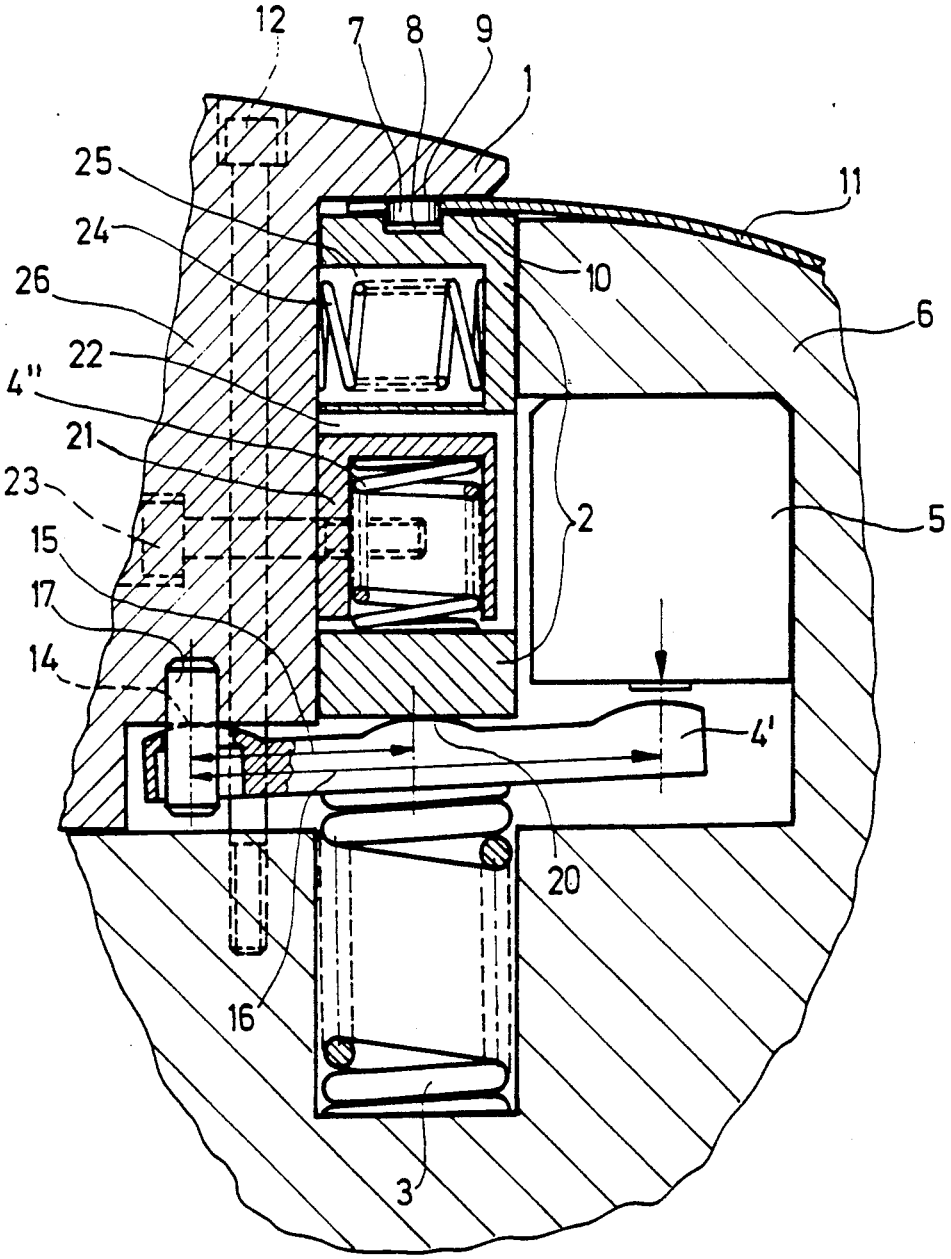
FIG. 4 is a view like that of FIG. 1 of a third embodiment of the invention.

FIG. 4 illustrates a further embodiment of the invention which provides force amplification. Parts in FIG. 4 bearing the same reference characters as those in the preceding figures perform like functions. This embodiment of FIG. 4 deviates from the embodiment illustrated in FIG. 3 in that the lever 4' of FIG. 4 is located between the spring element 3 and the lower clamping bar 2. When the adjusting device 5 is actuated, the spring element 3 is compressed and the spherical pressure area 20 located on the side of the lever 4' facing away from the spring 3 recedes or retreats from the lower clamping bar 2. For displacing the lower clamping bar 2, restoring springs 4'' are provided which are firmly connected to the cylinder housing 6 and press on the lower clamping bar 2 in a re-set direction, i.e., in the direction of the spring elements 3. In the embodiment shown in FIG. 4, a respective mounting support 21 fastened to the support 26 by means of screws 23 is inserted into at least two recesses 22, only one of which is shown in FIG. 4, formed in the lower clamping bar 2. The mounting support 21 has a downwardly-facing opening, as viewed in FIG. 4, and a respective restoring spring 4'' is disposed so that it presses against a lower defining surface of the recess 22, as viewed in the figure. The restoring springs 4'' must be constructed so that they overcome friction and gravity or inertia of the clamping bar 2 and permit the clamping bar 2 to follow the receding lever 4'. The gap between the clamping bars 1 and 2 is thereby enlarged, and a spent printing plate 11 may be removed and a new printing plate inserted. When the adjusting device 5 is retracted, the spring element 3 presses the lower clamping bar 2 again into its clamping position towards the upper clamping bar 1 by compressing the restoring springs 4''.

In the embodiment of FIG. 4, a pressure spring 24 is inserted between the support 26 connected to the cylinder housing 6 and the displaceable lower clamping bar 2. For receiving the pressure spring 24, the displaceable lower clamping bar 2 is formed with a blind hole which is open towards the support 26. The displaceable lower clamping bar 2 is thereby pressed by the support 26 in the direction of the cylinder housing 6, i.e., in the direction of the clamped printing plate 11. Due to this construction, the clamping bar 2 abuts neatly against the cylinder housing 6, preventing play which could otherwise result in an imprecise positioning of the printing plate 11. The pressure spring 24 may also be incorporated in the other embodiments of the invention.

Figure 5:
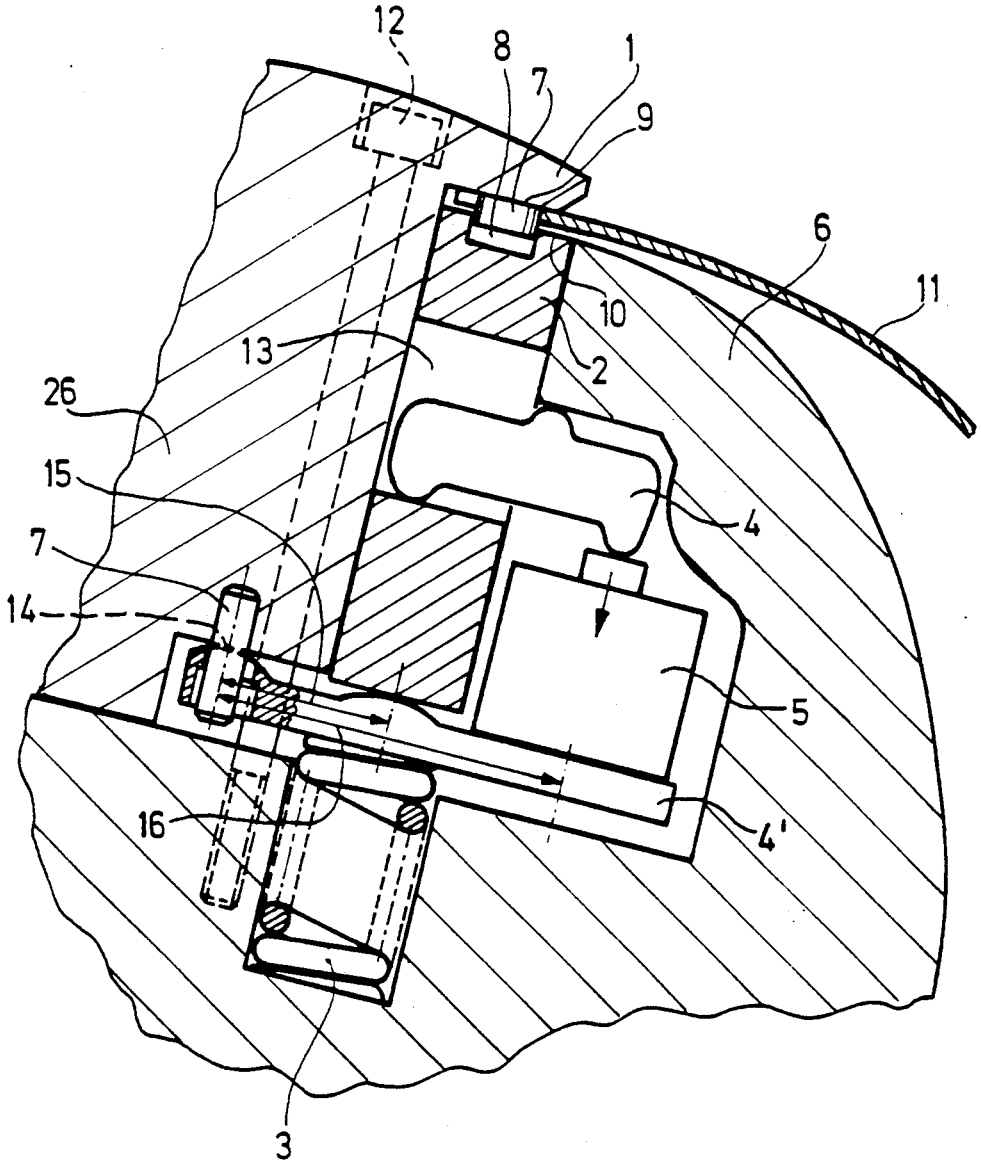
FIG. 5 is a view like that of FIG. 1 of a fourth embodiment of the invention wherein an increase in force is realized in a more compact construction.

FIG. 5 illustrates yet another embodiment of the invention, wherein a compact greater force amplification is realized. In principle, this embodiment constitutes a combination of the rocker 4 illustrated in FIG. 1 and the lever 4' illustrated in FIG. 3. The purpose of this combination is to take advantage of the counterforce exerted by the adjusting device 5 onto the cylinder housing 6 according to the embodiment of FIG. 3 so that an additional force acts upon the displaceable lower clamping bar 2. For this purpose, a lever 4' is arranged in the manner described hereinbefore in connection with FIG. 3, the adjusting device 5 being directly connected to the lever 4' at the end of the long lever arm 16, and an adjustable part of the adjusting device 5 acting upon a rocker 4 arranged as shown in FIG. 1. When actuating the adjusting device 5, the rocker 4, in turn, is pressed against a defining surface of a respective recess or hole 13 formed in the lower clamping bar 2 which thus moves downwardly. Simultaneously, the adjusting device 5 actuates the lever 4' so that the spring element 3 is compressed. While the spring element 3 is thus compressed by the lever 4', the lower clamping bar 2 is simultaneously pressed downwardly by the rocker 4. With a double amplification of the force of the lever 4' and a single-force transmission by means of the rocker 4, these forces add up to or result in a re-set force which acts upon the lower clamping bar 2 and corresponds to triple the force of the adjusting device 5. Of course, the length of the adjusting path of the adjusting device 5 must be suitably selected, because a triple force amplification requires triple the adjusting distance for the adjusting device 5 in order that an adequate re-setting of the lower clamping bar 2 be achieved. Further parts of the embodiment and functions thereof correspond to what has already been described hereinbefore.

In the embodiments of FIGS. 3 through 5, as well, the elements are advantageously arranged in a relatively great number along the length of the clamping bar 2, so that the printing plate 11 may be clamped and loosened uniformly over the entire clamping bar 2.

We claim:

1. Quick-action clamping device for fastening a printing plate on a plate cylinder in a printing machine having a radially outer fixed clamping bar and a radially inner, reciprocatingly movable clamping bar relatively movable into a clamping position and a plate-changing position, respectively, comprising register pins for precisely mounting and positioning the printing plate being carried by one of the clamping bars, the other of the clamping bars being formed with recesses located opposite said register pins, spring means for resiliently pressing the radially inner, reciprocatingly movable clamping bar into the clamping position with a holding force for clamping a printing plate between the radially inner, reciprocatingly movable clamping bar and the radially outer, fixed clamping bar, and re-setting means including at least one re-set element for removing said reciprocatingly movable clamping bar from said fixed clamping bar and returning the reciprocatingly movable clamping bar to the plate-changing position against said holding force, said resetting means being rigid with said radially inner, reciprocatingly movable clamping bar and being braced against an inner surface of the plate cylinder, and at least one piston/cylinder adjustment device carried within the plate cylinder and engageable with said re-set element for adjusting said radially inner, reciprocatingly movable clamping bar.

2. Quick-action clamping device according to claim 1, wherein the plate cylinder has a housing, and said re-set element comprises a rocker braced against said cylinder housing, respective ends of said rocker being operatively reciprocatingly movable with the displaceable clamping bar and said adjusting device.

3. Quick-action clamping device according to claim 1, wherein the plate cylinder has a housing formed with a supporting surface, and said re-set element comprises at least one lever having an end thereof braced against said supporting surface of said cylinder housing and said adjusting device for said lever, said lever having a relatively short lever arm operatively engageable with the displaceable clamping bar, and a relatively long lever arm operatively engageable with said adjusting device.

4. Quick-action clamping device according to claim 3, wherein said reciprocatingly movable clamping bar is formed with a recess, and said lever engages in said recess formed in the reciprocatingly movable clamping bar.

5. Quick-action clamping device according to claim 3, wherein said relatively short lever arm of said lever engages between said spring means and the reciprocatingly movable clamping bar, and including restoring spring means firmly connected to said cylinder housing for pressing the reciprocatingly movable clamping bar against said lever with a restoring force sufficient to, overcome friction and inertia of the reciprocatingly movable clamping bar.

6. Quick-action clamping device according to claim 3, wherein said adjusting device is disposed between said lever and one end of a rocker, said rocker being braced against said cylinder housing, the end of said rocker engaging in a recess formed in the reciprocatingly movable clamping bar, said relatively short lever arm of said lever engaging between said spring means and said displaceable clamping bar.

7. Quick-action clamping device according to claim 3, wherein said lever is formed with a bore, and including a retention pin projecting from said supporting surface of said cylinder housing, said retention pin engaging in said bore formed in said lever with sufficient play to afford movability of said lever.

8. Quick-action clamping device according to claim 1, including a support connected to said cylinder housing, and a pressure spring disposed between and in bracing engagement with said support and the reciprocatingly movable clamping bar for pressing the reciprocatingly movable clamping bar against said cylinder housing in a direction towards the clamped printing plate.

9. Quick-action clamping device according to claim 1, wherein said piston/cylinder adjusting device is a pneumatic adjusting device.

10. Quick-action clamping device according to claim 1, wherein said piston/cylinder adjusting device is an hydraulic adjusting device.

11. Quick-action clamping device according to claim 1, wherein the clamping bars have clamping surfaces coated with a material having a high coefficient of friction.

12. Quick-action clamping device according to claim 11, wherein said material coating said clamping surfaces is formed of tungsten carbide cobalt.

13. Quick-action clamping device according to claim 1, wherein the clamping bars have respective clamping surface, and one of the clamping surfaces of the clamping bars is formed as a smooth metal surface, and the other of said clamping surface is a knurled surface.

14. Quick-action clamping device according to claim 1, wherein said spring means comprise a plurality of spring elements.

* * * * *